US012623114B1

(12) United States Patent
Haas

(10) Patent No.: US 12,623,114 B1
(45) Date of Patent: May 12, 2026

(54) SHOULDER EXERCISE DEVICE

(71) Applicant: Corey Haas, Crest Hill, IL (US)

(72) Inventor: Corey Haas, Crest Hill, IL (US)

( * ) Notice: Subject to any disclaimer, the term of this patent is extended or adjusted under 35 U.S.C. 154(b) by 165 days.

(21) Appl. No.: 18/739,592

(22) Filed: Jun. 11, 2024

Related U.S. Application Data

(63) Continuation-in-part of application No. 18/200,035, filed on May 22, 2023, now Pat. No. 12,263,373.

(60) Provisional application No. 63/492,226, filed on Mar. 25, 2023.

(51) Int. Cl.
*A63B 23/12* (2006.01)
*A63B 21/00* (2006.01)
*A63B 21/015* (2006.01)

(52) U.S. Cl.
CPC ..... *A63B 23/1245* (2013.01); *A63B 21/015* (2013.01); *A63B 21/4035* (2015.10)

(58) Field of Classification Search
CPC . A63B 21/015; A63B 21/062; A63B 21/0626; A63B 21/0628; A63B 21/063; A63B 21/0632; A63B 21/15; A63B 21/151; A63B 21/154; A63B 21/169; A63B 21/4035; A63B 21/4045; A63B 21/4047; A63B 21/4049; A63B 23/1245
See application file for complete search history.

(56) References Cited

U.S. PATENT DOCUMENTS 588,017 A * 8/1897 Sandow ..... A63B 21/0552 482/129
4,204,719 A * 5/1980 Murphy ..... F16C 13/006 16/98
4,275,880 A * 6/1981 Murphy ..... F16C 19/507 482/43
4,340,215 A * 7/1982 Murphy ..... A63B 21/4009 16/98
4,340,216 A * 7/1982 Murphy ..... F16C 19/507 212/337
4,356,902 A * 11/1982 Murphy ..... F16C 19/507 384/418
4,632,392 A * 12/1986 Peyton ..... A63B 21/0618 482/110

(Continued)

FOREIGN PATENT DOCUMENTS

CN 109045610 A * 12/2018 ..... A63B 23/1245
KR 20180107574 A * 10/2018 ..... A63B 21/4035
WO WO-2022103256 A1 * 5/2022 ..... A63B 21/151

*Primary Examiner* — Gary D Urbiel Goldner
(74) *Attorney, Agent, or Firm* — Donald J. Ersler

(57) ABSTRACT

A shoulder exercise device includes four resistance lines, a central handle and a base frame. The base frame preferably includes four support posts, two horizontal frame members, two vertical frame members and two height adjustment handles. One end of each resistance line is retained by the central handle and an opposing end is terminated with a plug end. Two slide rails are attached to a vertical wall or surface. At least one sliding member is attached to a bottom of each vertical frame member. The at least two sliding members are slidably engaged with the two slide rails. The central handle may be replaced with a non-rotating handle. An alternative embodiment of the shoulder exercise device includes a cable, the central handle, a base frame and weight device. The base frame preferably includes four pulley support posts, two horizontal frame members, two vertical tube members and two height adjustment handles.

18 Claims, 11 Drawing Sheets

(56) References Cited

U.S. PATENT DOCUMENTS 5,016,874 A * 5/1991 Boardman ..... A63B 21/0552 482/122
5,498,223 A * 3/1996 Lams ..... A63B 21/1654 482/121
5,624,362 A * 4/1997 Wilson ..... A63B 21/156 482/102
5,718,654 A * 2/1998 Kennedy ..... A63B 21/4035 482/102
6,942,487 B2 * 9/2005 Corbalis ..... A63B 69/0093 472/91
7,666,126 B2 * 2/2010 Rempe ..... A63B 26/003 482/121
9,114,298 B2 * 8/2015 Ruggiero ..... A63B 69/20
10,434,365 B2 * 10/2019 Mack ..... A63B 21/0552
12,263,373 B1 * 4/2025 Haas ..... A63B 21/4049
2003/0153440 A1 * 8/2003 Kim ..... A63B 21/156 482/122
2004/0082448 A1 * 4/2004 Martin ..... A63B 21/4017 482/139
2005/0192170 A1 * 9/2005 Cleveland ..... A63B 23/03508 482/148
2006/0252614 A1 * 11/2006 Rotondale ..... A63B 21/0628 482/99
2007/0161468 A1 * 7/2007 Yanagisawa ..... A63B 21/0552 482/139
2013/0079203 A1 * 3/2013 Jones ..... A63B 21/151 482/130
2014/0357458 A1 * 12/2014 Callanan ..... A63B 21/0442 482/129
2015/0087486 A1 * 3/2015 Franks ..... A63B 21/0442 482/129
2015/0314159 A1 * 11/2015 Buckman ..... A63B 21/00065 482/129
2018/0133546 A1 * 5/2018 Boddie ..... A63B 21/0552
2021/0260436 A1 * 8/2021 McCrea ..... A63B 21/0552
2022/0347522 A1 * 11/2022 Boddie ..... A63B 24/0062
2022/0409958 A1 * 12/2022 Boddie ..... A63B 24/0087

* cited by examiner

SHOULDER EXERCISE DEVICE

CROSS-REFERENCES TO RELATED APPLICATIONS

This is a continuation-in-part patent application which takes priority from patent application Ser. No. 18/200,035, filed on May 22, 2023, which claims the benefit of patent application Ser. No. 63/492,226, filed on Mar. 25, 2023.

BACKGROUND OF THE INVENTION

1. Field of the Invention

The present invention relates generally to physical therapy and more specifically to a shoulder exercise device, which may be used by an individual to strengthen muscles of the shoulder without the aid of a therapist.

2. Discussion of the Prior Art

Shoulder exercises help strengthen the rotator cuff muscles, deltoid muscles, and various other adjacent muscle groups. Strengthening the shoulder muscles is beneficial not only for functional strength but also to restore strength to a shoulder after various shoulder surgeries. A physical therapist is trained to rehabilitate post operative shoulders by using a variety of exercises that isolate individual muscles/muscle groups with different movements which are done with gradual increases in resistance. Certain exercise techniques using resistance via resistance tubing/bands or exercise machines can be performed solely by the rehabilitating person while other strengthening exercises have to be completed with the assistance of a therapist.

Accordingly, there is a clearly felt need in the art for a shoulder exercise device, which allows an individual to strengthen certain muscles of the shoulder without the aid of a therapist and may be mounted to a vertical surface, such as a wall.

SUMMARY OF THE INVENTION

The present invention provides a shoulder exercise device, which may be mounted to a vertical surface, such as a wall. The shoulder exercise device preferably includes a central handle, a stationary origin post, at least two stationary posts and a resistance line. The central handle preferably includes an upper pivot ring, a lower pivot ring, a rotating handle, a plurality of pivoting pulley yokes and a plurality line pulleys. The rotating handle preferably includes a handle ring, a plurality of ball bearings and a handle portion. Opposing ends of the handle portion are attached to handle tabs, which extend from an inner perimeter of the handle ring. A bearing groove is formed in an outer perimeter of the handle ring to receive the plurality of ball bearings. The upper pivot ring includes an upper handle bore and a plurality of upper pivot extensions. The upper handle bore is sized to receive the rotating handle. A plurality of upper pivot extensions extend from an outer perimeter of the upper pivot ring. An upper pivot hole is formed through each upper pivot extension. The lower pivot ring includes a lower handle bore and a plurality of lower pivot extensions. The lower handle bore is sized to receive the rotating handle. A plurality of lower pivot extensions extend from an outer perimeter of the lower pivot ring. A lower pivot hole is formed through each lower pivot extension.

Each pivoting pulley yoke includes a pulley yoke, a pivot tab and a pulley. The pivot tab extends from the pulley yoke. The pulley yoke includes an inner slot which is sized to receive a thickness of the line pulley. A fastener hole is formed through the pulley yoke to receive a pulley fastener. The pulley fastener pivotally retains the pulley in the pulley yoke. A pivot hole is formed through the pivot tab. The pivot hole is preferably perpendicular to the pulley fastener. A pivot fastener is retained in the upper pivot hole, the lower pivot hole and the pivot hole to pivotally retain the pivoting pulley yoke. The stationary origin post includes a stationary origin base, a stationary origin upright member, a line retainer and a line retention projection. The upright member extends upward from the stationary origin base. A top of the stationary origin upright member is terminated with line retainer. The line retainer includes a line origin hole and a line passthrough hole. The line retention projection extends from a rear of the stationary upright origin member.

The stationary post includes a stationary base, a stationary upright member and the pivoting pulley yoke. The stationary upright member extends upward from the stationary base. A pivot slot is formed in a top of the stationary upright member to receive the pivoting pulley yoke. The pivoting pulley yoke is pivotally engaged with the stationary upright member with a pivot fastener. In use, the bases of the stationary origin post and the stationary post are mounted to a vertical surface, such as a wall. One end of the resistance line is inserted through the line origin hole of the stationary origin post and knotted anchor thereof. The resistance line is inserted through a first pulley of the central handle; a pulley of a first stationary support; a second pulley of the central handle; a pulley of the second stationary support; a third pulley of the central handle; through the line passthrough hole; and wrapped around the line retention projection. An alternative embodiment of the shoulder exercise device includes a central handle with four pivoting pulley yokes instead of three and three stationary posts instead of two stationary posts.

A shoulder exercise device includes four resistance lines, a central handle and a base frame. The base frame preferably includes four support posts, two horizontal frame members, two vertical frame members and two height adjustment handles. Each support post includes a vertical post, a first gusset and a second gusset. The first gusset extends from one side of the vertical post and the second gusset extends from a second side of the vertical post, such that the first gusset is perpendicular to the second gusset. A frame member slot is formed in a bottom of each gusset to receive a vertical or horizontal frame member. The two height adjustment handles are attached to the two vertical frame members.

Each height adjustment handle preferably includes a handle frame, a squeeze member, an indexing strap, an indexing projection and at least one biasing member. The handle frame preferably includes a member cavity and a hand opening, which is formed through the member cavity. The member cavity is sized to receive the squeeze member. The squeeze member includes a hand opening formed through a side thereof. The indexing projection is retained in a bottom of the squeeze member. The indexing strap includes an indexing guide projection formed in a middle thereof for receiving the indexing projection. A pair of attachment flanges extend from opposing sides of the handle frame. A pair of bolts are inserted through the pair of attachment flanges and opposing ends of the indexing strap to retain the height adjustment handle on the vertical frame member. The at least one biasing member is preferably a compression spring to bias the squeeze member away from the handle frame.

One end of each resistance line is attached to the central handle and an opposing end is terminated with a resistance line plug. The resistance plug includes a plug end and a barbed tube end, which is preferably perpendicular to the plug end. The barbed tube end is sized to receive an inner perimeter of a tubular resistance line. The plug end is sized to be received by one of a plurality of tension holes in the vertical post of one of the four support posts. Two slide rails are attached to a vertical wall or surface.

At least one sliding member is attached to a bottom of each vertical frame member. The at least two sliding members are slidably engaged with the two slide rails. A slide cavity is formed in a cross section of each slide rail. The slide cavity includes two opposed inward facing curved projections. A plurality of indexing holes are formed through a length of the two slide rails. Each sliding member includes a slide base and a plurality of slide pulleys. The plurality of slide pulleys are sized to receive the inward facing curved projections.

A shoulder exercise device includes four resistance lines, a central handle and a base frame. The base frame preferably includes four double hole support posts, two horizontal frame members, two vertical frame members and two height adjustment handles. Each support post includes a vertical post, a first gusset and a second gusset. The first gusset extends from one side of the vertical post and the second gusset extends from a second side of the vertical post, such that the first gusset is perpendicular to the second gusset. A frame member slot is formed in a bottom of each gusset to receive a vertical or horizontal frame member. Two resistance line holes are formed through a top of each vertical post.

One end of each resistance line is terminated with stop flange and the other end is terminated with a resistance line plug. One end of the resistance line is retained in a resistance line hole in one vertical post and the resistance line plug is inserted through a resistance line hole of an adjacent vertical post. The two height adjustment handles are attached to the two vertical frame members. Each resistance line is retained in one of the pivoting pulley yokes extending from the central handle. The resistance line plug is sized to be received by one of a plurality of tension holes in the vertical post of one of the four support posts. Two slide rails are attached to a vertical wall or surface. At least one sliding member is attached to a bottom of each vertical frame member. The at least two sliding members are slidably engaged with the two slide rails.

A shoulder exercise device includes four resistance lines, a non-rotating handle and a base frame. The non-rotating handle preferably includes a hand ring, a grasping handle and eight equally spaced projections. The grasping handle is retained in an inner perimeter of the hand ring. The eight equally spaced projections extend from an outer perimeter of the hand ring. A line hole is formed through each projection. The base frame preferably includes four support posts, two horizontal frame members, two vertical frame members and two height adjustment handles. The two height adjustment handles are attached to the two vertical frame members. One end of each resistance line is secured in the line hole of the non-rotating handle and the other end is terminated with a resistance line plug. The resistance line plug is sized to be received by one of a plurality of tension holes formed in the vertical post of one of the four support posts. Two slide rails are attached to a vertical wall or surface. At least one sliding member is attached to a bottom of each vertical frame member. The at least two sliding members are slidably engaged with the two slide rails. A slide cavity is formed in a cross section of each slide rail. The slide cavity includes two opposed inward facing curved projections. A plurality of indexing holes are formed through a length of the two slide rails. Each sliding member includes a slide base and a plurality of slide pulleys. The plurality of slide pulleys are sized to receive the inward facing curved projections.

A shoulder exercise device includes a single cable, the central handle, a base frame and a weight device. The base frame preferably includes four pulley support posts, two horizontal frame members, two vertical frame members and two height adjustment handles. Each pulley support post includes a vertical post, a first gusset, a second gusset and a pulley. The pulley is disposed on a top of the vertical post. The single cable is routed through four pulleys on the central handle and the four pulleys on the four support posts. The weight device includes a weight frame, an adjustable weight lift and a plurality of routing pulleys. Preferably, the base frame is slidably mounted to a front of the weight frame and adjustable weight lift is slidably retained in a side of the weight frame. The plurality routing pulleys are also rotatably mounted to a side of the weight frame.

A user pulls and/or twists the central handle, which requires the user overcome at least one weight in a weight stack. The two height adjustment handles are attached to the two vertical frame members. The two vertical frame members are slidably retained on two vertical weight frame members of the weight frame.

Accordingly, it is an object of the present invention to provide a shoulder exercise device, which allows an individual to strengthen certain muscles of the shoulder without the aid of a therapist.

Finally, it is another object of the present invention to provide a shoulder exercise device, which may be mounted to a vertical surface, such as a wall.

These and additional objects, advantages, features and benefits of the present invention will become apparent from the following specification.

DETAILED DESCRIPTION OF THE PREFERRED EMBODIMENTS

Figure 1:
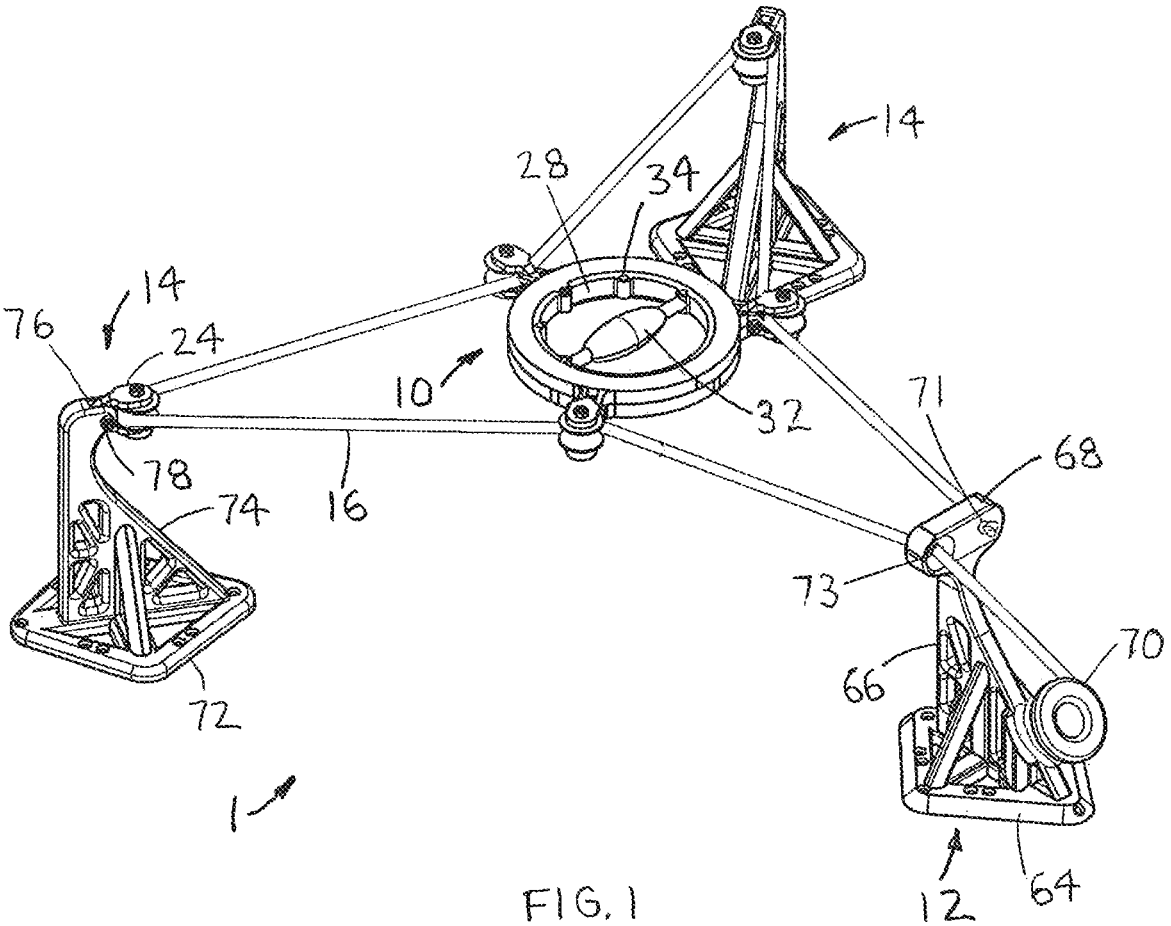
FIG. 1 is a perspective view of a shoulder exercise device having three support posts in accordance with the present invention.

With reference now to the drawings, and particularly to FIG. 1, there is shown a shoulder exercise device 1. The shoulder exercise device 1 preferably includes a central handle 10, a stationary origin post 12, at least two stationary posts 14 and a resistance line 16. With reference to FIGS. 2-5, the central handle 10 preferably includes an upper pivot ring 18, a lower pivot ring 20, a rotating handle 22, a plurality of pivoting pulley yokes 24 and a plurality line pulleys 26. The rotating handle 22 preferably includes a handle ring 28, a plurality of ball bearings 30 and a handle portion 32. Opposing ends of the handle portion 32 are attached to handle tabs 34, which extend from an inner perimeter of the handle ring 28. A bearing groove 36 is formed in an outer perimeter of the handle ring 28 to receive the plurality of ball bearings 30. The upper pivot ring 18 includes an upper handle bore 38 and a plurality of upper pivot extensions 40. The upper handle bore 38 is sized to receive the ball bearings 30 of the rotating handle 22. The upper and lower pivot rings 18, 20 are attached to each other with pins, fasteners or any other suitable attachment device or method. The plurality of upper pivot extensions 40 extend from an outer perimeter of the upper pivot ring 18. An upper pivot hole 42 is formed through each upper pivot extension 40. The lower pivot ring 20 includes a lower handle bore 44 and a plurality of lower pivot extensions 46. The lower handle bore 44 is sized to receive the ball bearings 30 of the rotating handle 22. The plurality of lower pivot extensions 46 extend from an outer perimeter of the lower pivot ring 20. A lower pivot hole 48 is formed through each lower pivot extension 46.

Each pivoting pulley yoke 24 includes a pulley yoke 50, a pivot tab 52 and the line pulley 26. The pivot tab 52 extends from the pulley yoke 50. The pulley yoke 50 includes an inner slot 54, which is sized to receive a thickness of the line pulley 26. A fastener hole 56 is formed through the pulley yoke 50 to receive a pulley fastener 58. The pulley fastener 58 pivotally retains the line pulley 26 in the pulley yoke 50. The line pulley 26 may include a ball bearing set or a bushing. A pivot hole 60 is formed through the pivot tab 52. The pivot hole 60 is preferably perpendicular to the pulley hole 56. A pivot fastener 62 is retained in the upper pivot hole 42, the lower pivot hole 48 and the pivot hole 60 to pivotally retain the pivoting pulley yoke 24. However, a ball joint may be used instead a pivot fastener 62 to pivot the pulley yoke relative to the central handle 10.

Figure 2:
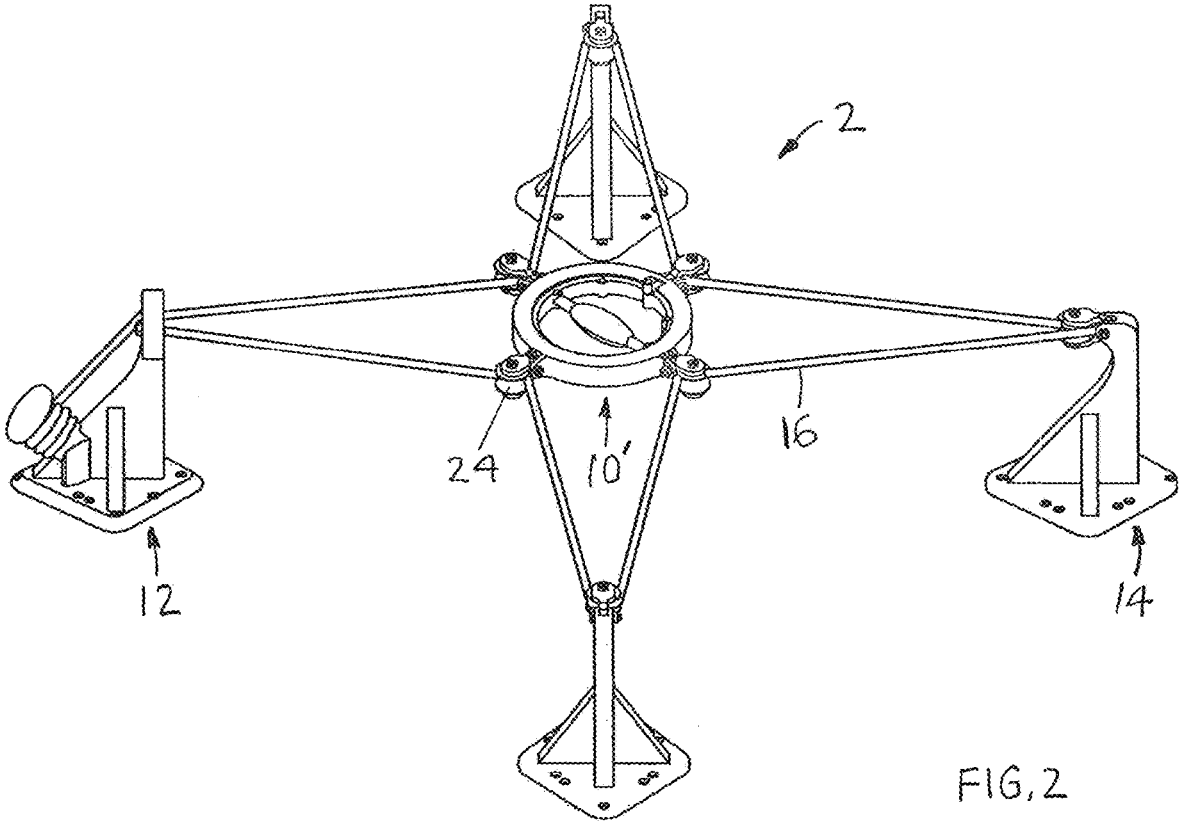
FIG. 2 is a perspective view of a shoulder exercise device having four support posts in accordance with the present invention.
Figure 3:
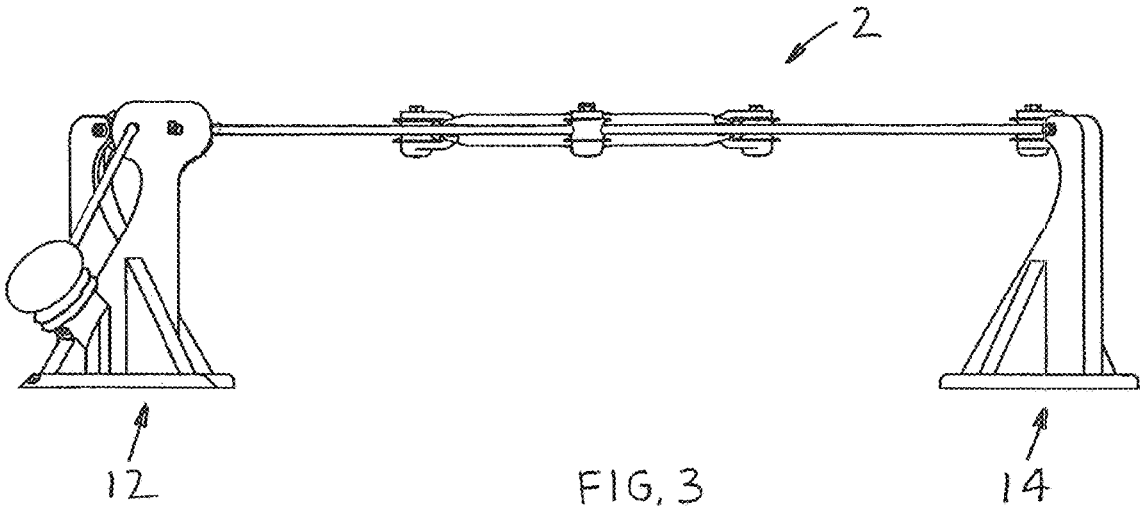
FIG. 3 is a front view of a shoulder exercise device having four support posts in accordance with the present invention.
Figure 4:
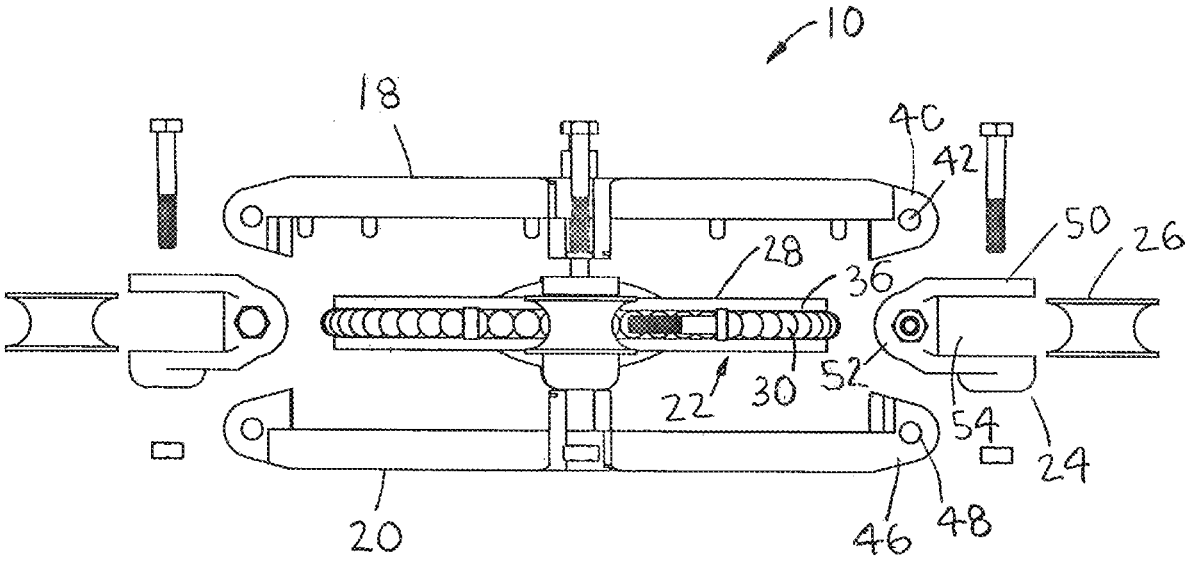
FIG. 4 is a front exploded view of a central handle of a shoulder exercise device in accordance with the present invention.
Figure 5:
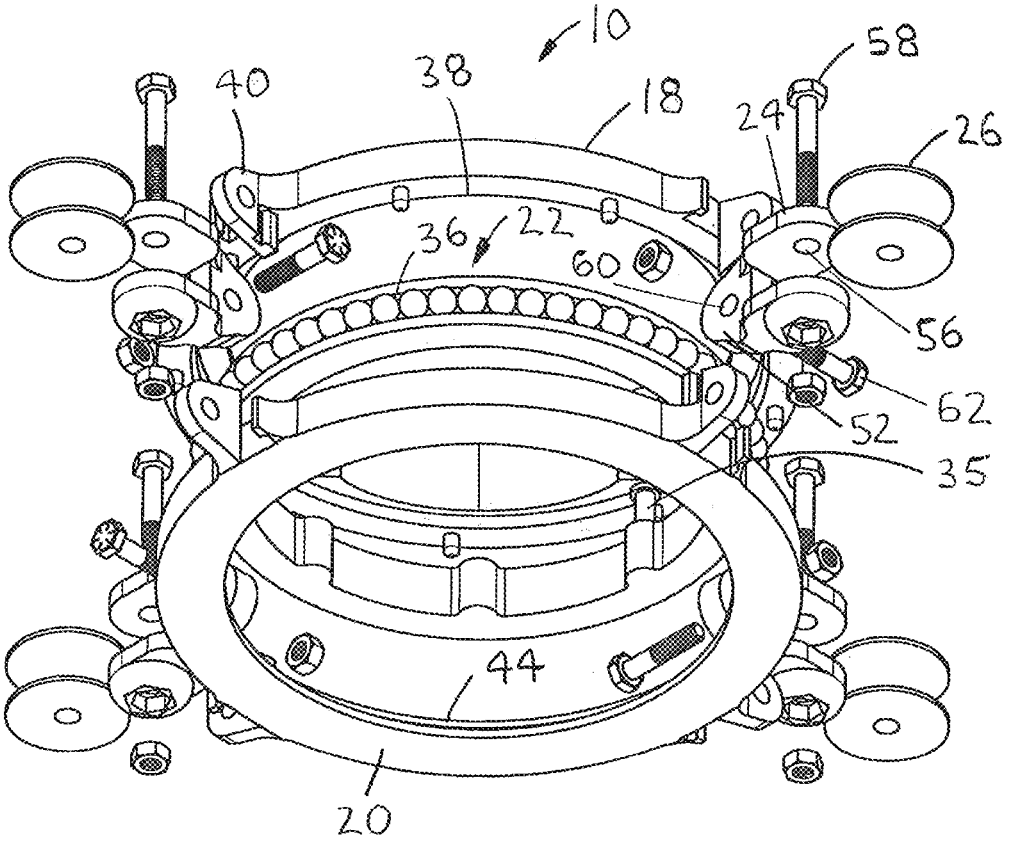
FIG. 5 is a perspective exploded view of a central handle of a shoulder exercise device in accordance with the present invention.

The stationary origin post 12 includes a stationary origin base 64, a stationary origin upright member 66, a line retainer 68 and a line retention projection 70. The origin upright member 66 extends upward from the stationary origin base 64. A top of the stationary origin upright member 66 is terminated with line retainer 68. The line retainer 68 includes a line origin hole 71 and a line passthrough hole 73. The line retention projection 70 extends from a rear of the stationary upright origin member. However, the line retention projection 70 may be replaced with a ratcheting crank and a reel or the like. The stationary post 14 includes a stationary base 72, a stationary upright member 74 and the pivoting pulley yoke 24. The stationary upright member 74 extends upward from the stationary base 72. A pivot slot 76 is formed in a top of the stationary upright member 74 to receive the pivoting pulley yoke 24. The pivoting pulley yoke 24 is pivotally engaged with the stationary upright member 74 with a pivot fastener 78. With reference to FIGS. 2-3, a shoulder exercise device includes a central handle 10', the stationary origin post 12, three stationary posts 14 and the resistance line 16. The central handle 10' includes four pivoting pulley yokes 24.

In use, the bases 64, 72 of the stationary origin post 12 and the stationary posts 14 are mounted to a vertical surface, such as a wall. The posts 12, 14 are secured to the vertical surface by inserting fasteners through the bases 64, 72. The posts 12, 14 are located on the vertical surface, such that a center of the handle portion 32 is at shoulder height of a user. One end of the resistance line 16 is inserted through the line origin hole 71 of the stationary origin post 12 and knotted to anchor thereof. It is preferable to have a bearing in the line origin hole 71 to prevent twisting of the resistance line 16, relative to the stationary origin post 12. The resistance line 16 is inserted through a first line pulley 26 of the central handle 10; the line pulley 26 of a first stationary support 14; a second pulley 24 of the central handle 22; the pulley 24 of the second stationary support 14; a third pulley 24 of the central handle 10; through the line passthrough hole 73; inserted through a hole (not shown) in the line retention projection 70; and wrapped around the line retention projection 70. The resistance line 16 is preferably fabricated from a resilient or elastic material, but could be fabricated from a non-resilient material. A spring could be used in conjunction with a non-elastic material. Further, a cable or rope could be terminated with removable weights instead of an elastic resistance line 16. The cable would have linear motion relative to the line retainer 68. The rotating handle 22 may be pinned to the upper pivot ring 18 and/or lower pivot rings 18, 20 to prevent rotation thereof with a pin or the like. The user may move the central handle 10 in a circular fashion, left, right, up, down or any angle in between to exercise their shoulder. The pivoting pulley yokes 24 enable the user to extend or retract the shoulder before moving the central handle 10 for exercises allowing for movements on multiple planes.

Figure 6:
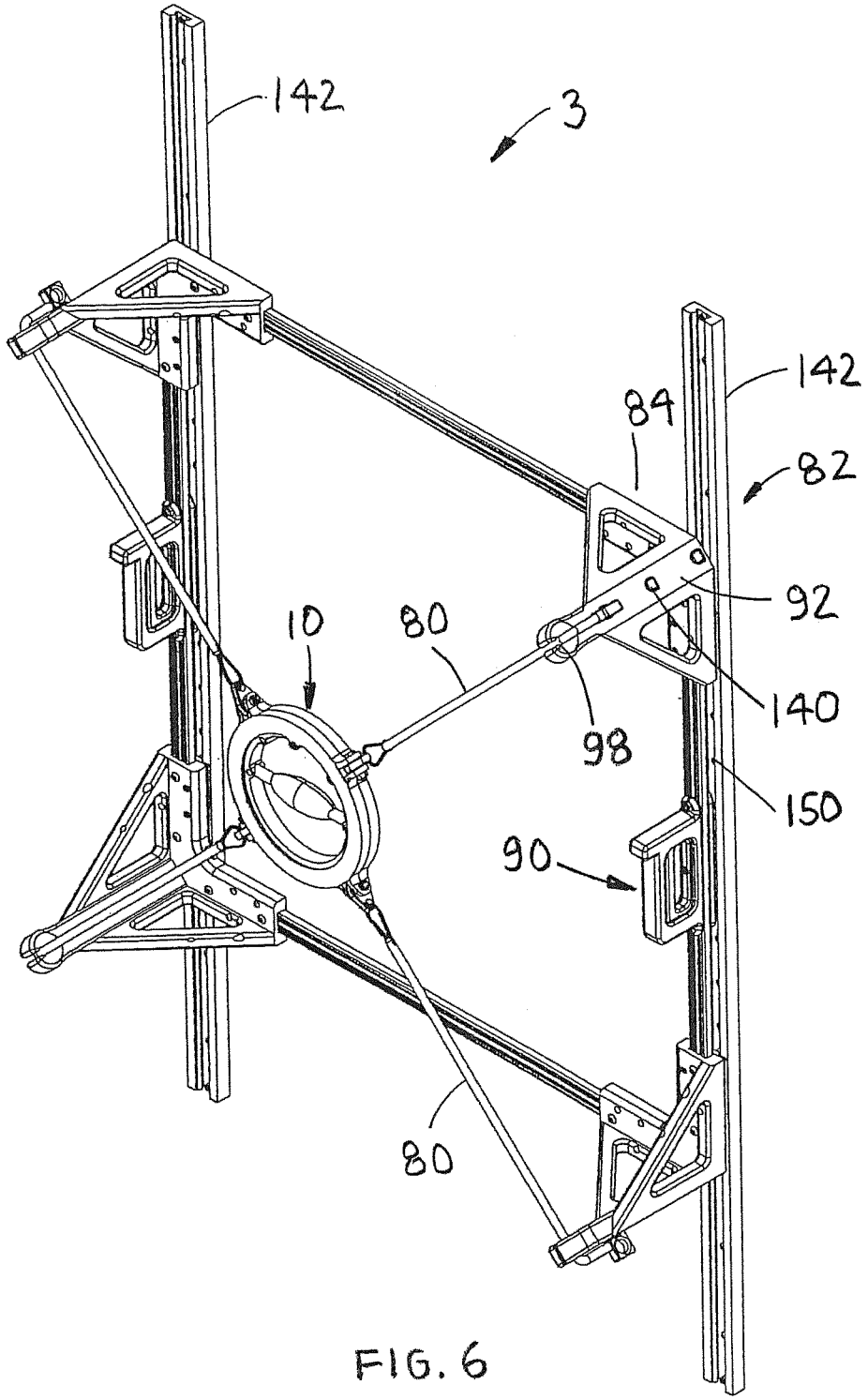
FIG. 6 is a perspective view of a shoulder exercise device having four support posts retained on a height adjustable rack, which is mounted to a vertical surface, a single resistance line is attached to a single support post in accordance with the present invention.
Figure 10:
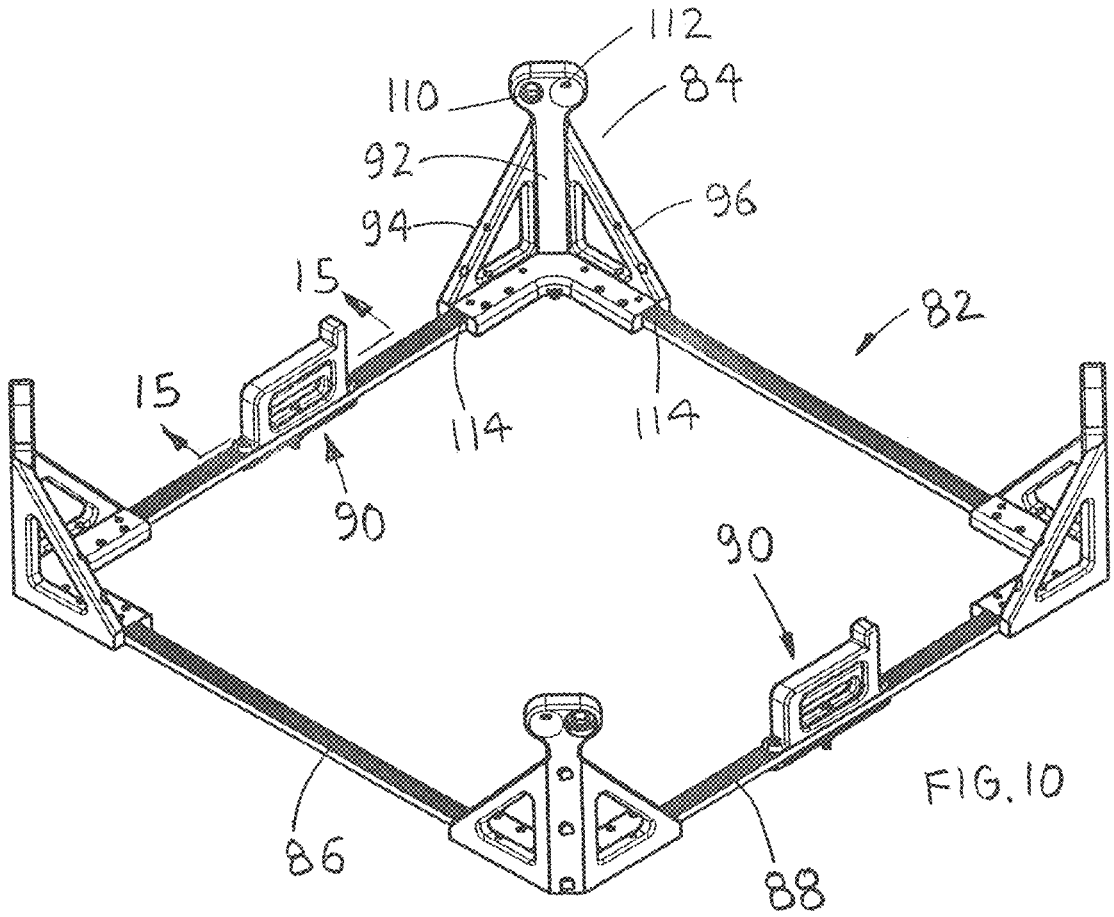
FIG. 10 is a perspective view of a base frame of a shoulder exercise device having four support posts in accordance with the present invention.

With reference to FIG. 6, a shoulder exercise device 3 includes four resistance lines 80, the central handle 10 and a base frame 82. With reference to FIG. 10, the base frame 82 preferably includes four support posts 84, two horizontal frame members 86, two vertical frame members 88 and two height adjustment handles 90. However, the shoulder exercise device 3 may be operated with only two support posts 84. The central handle 10 would be supported by the two support posts 84 in opposing corners of the base frame 82. With reference to FIG. 10, each support post 84 includes a vertical post 92, a first gusset 94 and a second gusset 96. The first gusset extends 94 from one side of the vertical post 92 and the second gusset 96 extends from a second side of the vertical post 92, such that the first gusset 94 is perpendicular to the second gusset 96. A resistance line slot 98 may be formed in a top of the he vertical post 92. Alternatively, a first resistance line hole 110 and a second resistance line hole 112 may be formed in a top of the vertical post 92. A frame member slot 114 is formed in a bottom of each gusset 94, 96 to receive the vertical or horizontal frame member 86, 88. The two-height adjustment handles 90 are attached to the two vertical frame members 88.

Figure 15:
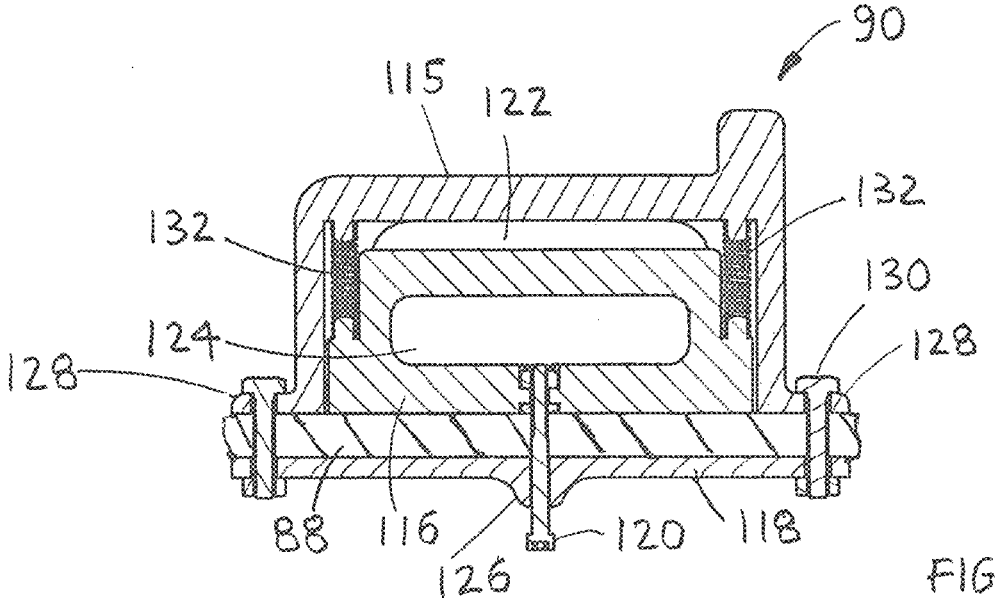
FIG. 15 is a cross sectional view of a height adjustment handle of a base frame of a shoulder exercise device in accordance with the present invention.

With reference to FIG. 15, each height adjustment handle 90 preferably includes a handle frame 115, a squeeze member 116, an indexing strap 118, an indexing projection 120 and at least one biasing member. The handle frame 115 preferably includes a member cavity 122 and a hand opening, which is formed through the member cavity 122. The member cavity 122 is sized to receive the squeeze member 116. The squeeze member 116 includes a hand opening 124 formed through a side thereof. The indexing projection 120 is retained in a bottom of the squeeze member 116. The indexing strap 118 includes an indexing guide projection 126 formed in a middle thereof. A pair of attachment flanges 128 extend from opposing ends of the handle frame 114. A pair of bolts 130 are inserted through the pair of attachment flanges 128 and opposing ends of the indexing strap 118. The at least one biasing member is preferably a compression spring 132 to bias the squeeze member 116 away from the handle frame 114.

Figure 11:
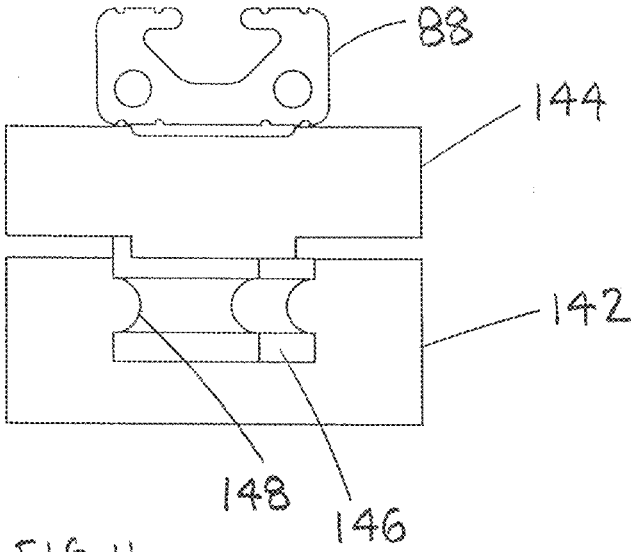
FIG. 11 is an end view of a sliding member attached to a vertical support member of a base frame and the sliding member slidably engaged with a slide rail of a shoulder exercise device in accordance with the present invention.
Figure 12:
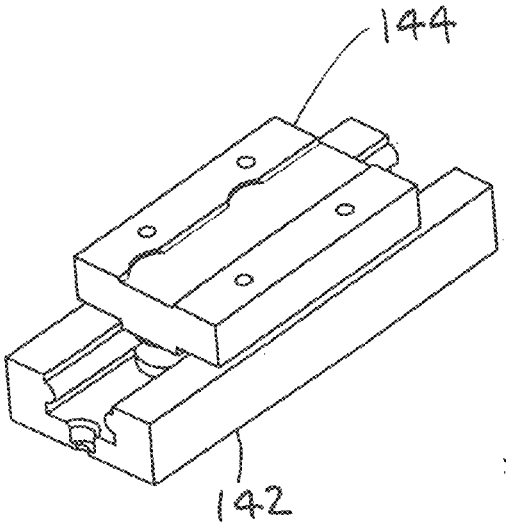
FIG. 12 is a perspective view of a sliding member slidably engaged with a slide rail of a shoulder exercise device in accordance with the present invention.
Figure 13:
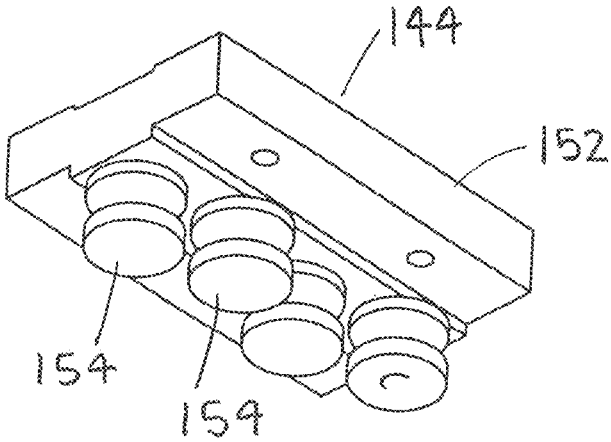
FIG. 13 is a bottom perspective view of a sliding member of a shoulder exercise device in accordance with the present invention.
Figure 17:
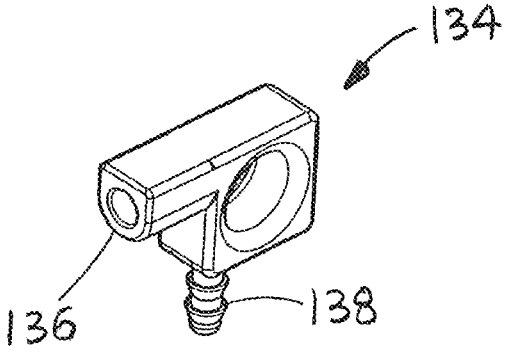
FIG. 17 is a perspective view of a resistance line location plug of a shoulder exercise device in accordance with the present invention.

With reference to FIG. 17, one end of each resistance line 80 is pivotally attached to the central handle 10 and an opposing end is terminated with a resistance line plug 134. The resistance line plug 134 includes a plug end 136 and a barbed tube end 138, which is preferably perpendicular to the plug end 136. The barbed tube end 138 is sized to receive an inner perimeter of the resistance line 80. The plug end 136 is sized to be received by one of a plurality of tension holes 140 in the vertical post 92 of one of the four support posts 84. Two slide rails 142 are attached to a vertical wall or surface. With reference to FIGS. 11-13, at least one sliding member 144 is attached to a bottom of each vertical frame member 88. The at least two sliding members 144 are slidably engaged with the two slide rails 142. A slide cavity 146 is formed in a cross section of each slide rail 142. The slide cavity 146 includes two opposed inward facing curved projections 148. A plurality of indexing holes 150 are formed along a length of the two slide rails 142 to receive the indexing projection 120. Each sliding member 144 includes a slide base 152 and a plurality of slide pulleys 154. The plurality of slide pulleys 154 are sized to receive the inward facing curved projections 148.

Figure 7:
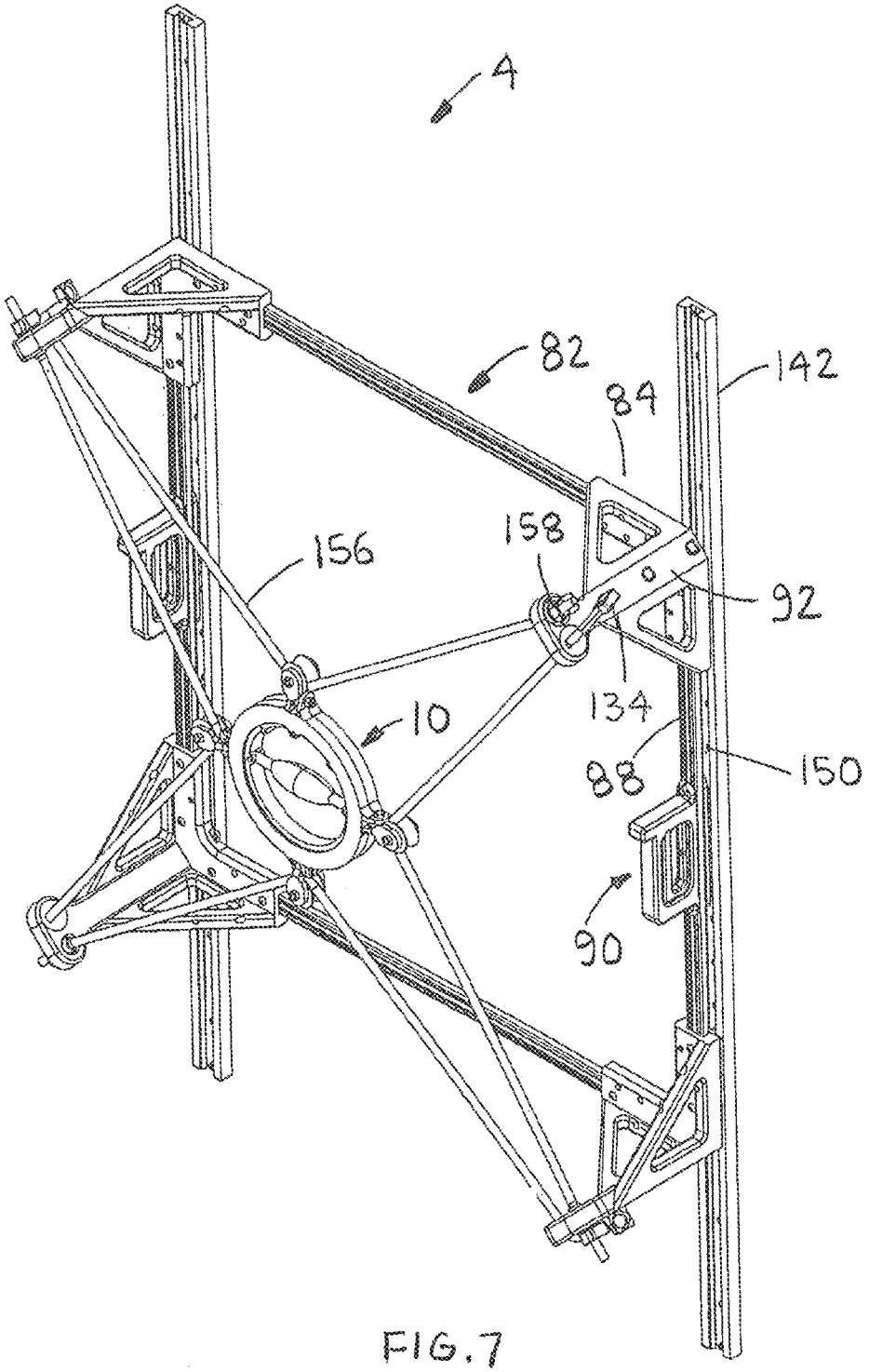
FIG. 7 is a perspective view of a shoulder exercise device having four support posts retained on a height adjustable rack, which is mounted to a vertical surface, opposing ends of a single resistance line are attached to two adjacent support posts in accordance with the present invention.
Figure 9:
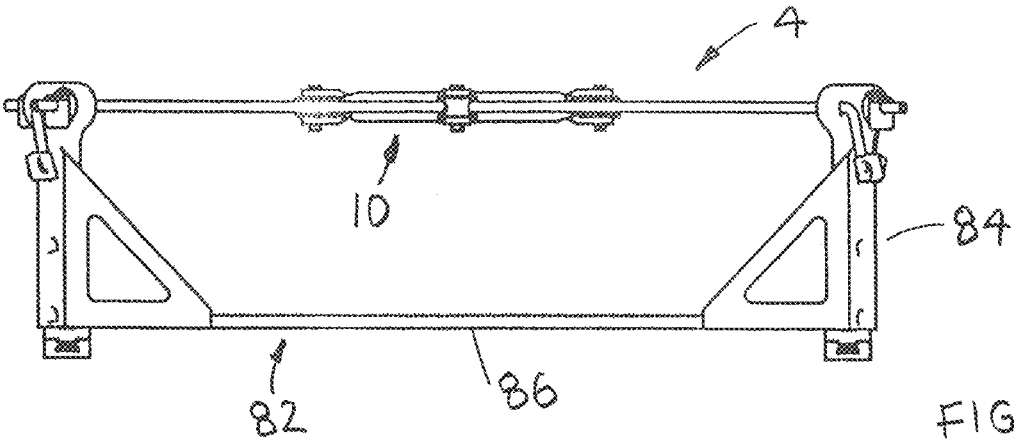
FIG. 9 is an end view of a shoulder exercise device having four support posts retained on a height adjustable rack, which is mounted to a vertical surface, opposing ends of a single resistance line are attached to two adjacent support posts in accordance with the present invention.
Figure 8:
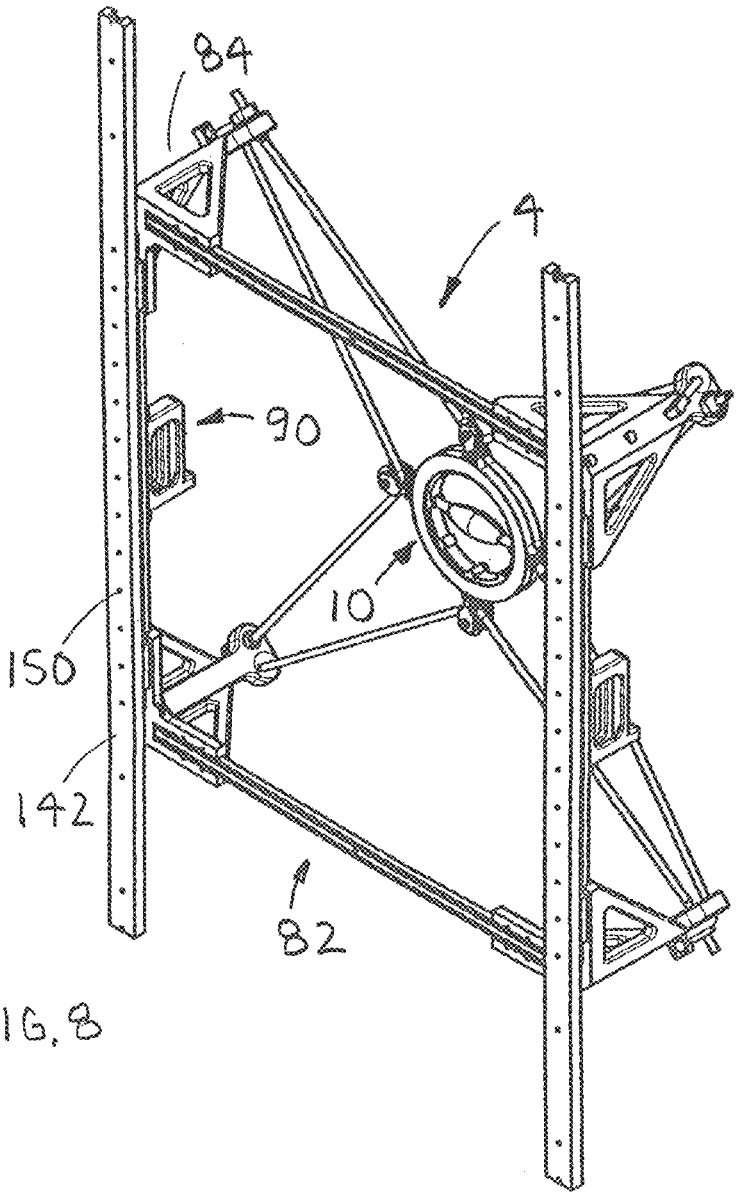
FIG. 8 is a bottom perspective view of a shoulder exercise device having four support posts retained on a height adjustable rack, which is mounted to a vertical surface, opposing ends of a single resistance line are attached to two adjacent support posts in accordance with the present invention.

With reference to FIG. 7, a shoulder exercise device 4 preferably includes four resistance lines 156, the central handle 10 and the base frame 82. The base frame 82 preferably includes the four support posts 84, the two horizontal frame members 86, the two vertical frame members 88 and the two height adjustment handles 90. However, the shoulder exercise device 4 may be operated with only two support posts 84. The central handle 10 would be supported by the two support posts 84 in opposing corners of the base frame 82. Opposing ends of a resistance line 156 would be retained in the same support post 84. Each support post 84 includes first and second resistance line holes 110, 112 formed through a top of the vertical post 92. One end of each resistance line 156 is terminated with stop flange 158 and the other end is terminated with the resistance line plug 134. One end of the resistance line 156 is retained in the first resistance line hole 110 in one vertical post 92 and the resistance line plug 134 is inserted through the second resistance line hole 112 of an adjacent vertical post 92. The two height adjustment handles 90 are attached to the two vertical frame members 88. Each resistance line 156 is retained in one of the pivoting pulley yokes 24 extending from the central handle 10. The plug end 136 is sized to be received by one of the plurality of tension holes 140 in the vertical post 92 of one of the four support posts 84. The two slide rails 142 are attached to a vertical wall or surface. The at least one sliding member 144 is attached to a bottom of each vertical frame member 88. The at least two sliding members 144 are slidably engaged with the two slide rails 142.

Figure 14:
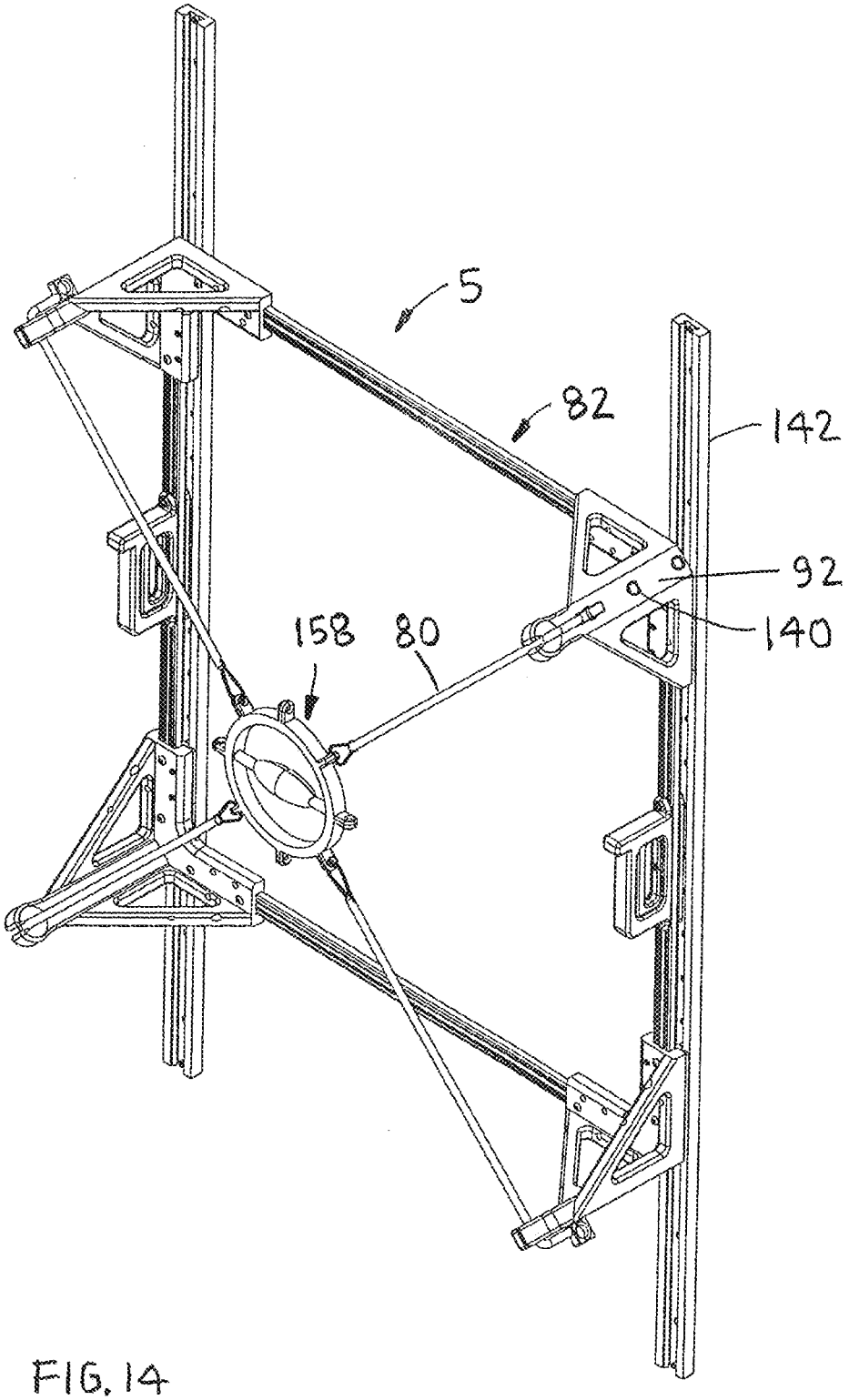
FIG. 14 is a perspective view of a shoulder exercise device having base frame with four support posts retained, which is mounted to a vertical surface, a single resistance line is attached to a single support post and a non-rotating handle in accordance with the present invention.
Figure 16:
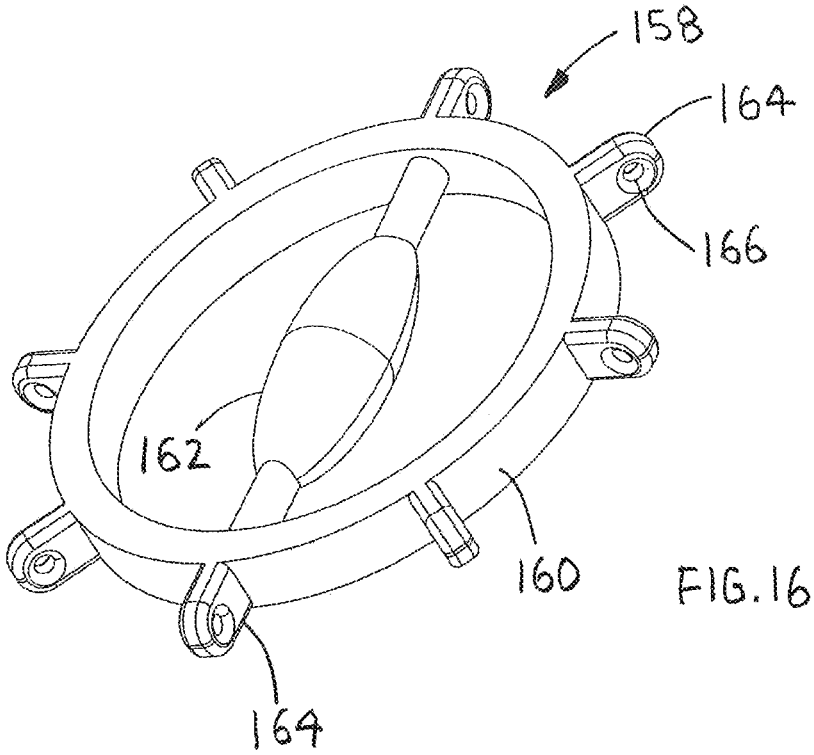
FIG. 16 is a perspective view of a non-rotating handle of a shoulder exercise device in accordance with the present invention.

With reference to FIG. 14, a shoulder exercise device 5 includes the four resistance lines 80, a non-rotating handle 158 and the base frame 82. With reference to FIG. 16, the non-rotating handle 158 preferably includes a hand ring 160, a grasping handle 162 and eight equally spaced projections 164. The grasping handle 162 is retained in an inner perimeter of the hand ring 160. The eight equally spaced projections 164 extend from an outer perimeter of the hand ring 160. A line hole 166 is formed through each projection 164. However, the shoulder exercise device 5 may be operated with only two support posts 84. The central handle 158 would be supported by the two support posts 84 in opposing corners of the base frame 82. The base frame 82 preferably includes four support posts 84, the two horizontal frame members 86, the two vertical frame members 88 and the two height adjustment handles 90. The two height adjustment handles 90 are attached to the two vertical frame members 88. One end of each resistance line 80 is secured in the line hole 166 of the non-rotating handle 158 and the other end is terminated with the resistance line plug 134. The plug end 136 is sized to be received by one of a plurality of tension holes 140 formed in the vertical post 92 of one of the four support posts 84. The two slide rails 142 are attached to a vertical wall or surface. At least one sliding member 144 is attached to a bottom of each vertical frame member 88. The at least two sliding members 144 are slidably engaged with the two slide rails 142.

Figure 18:
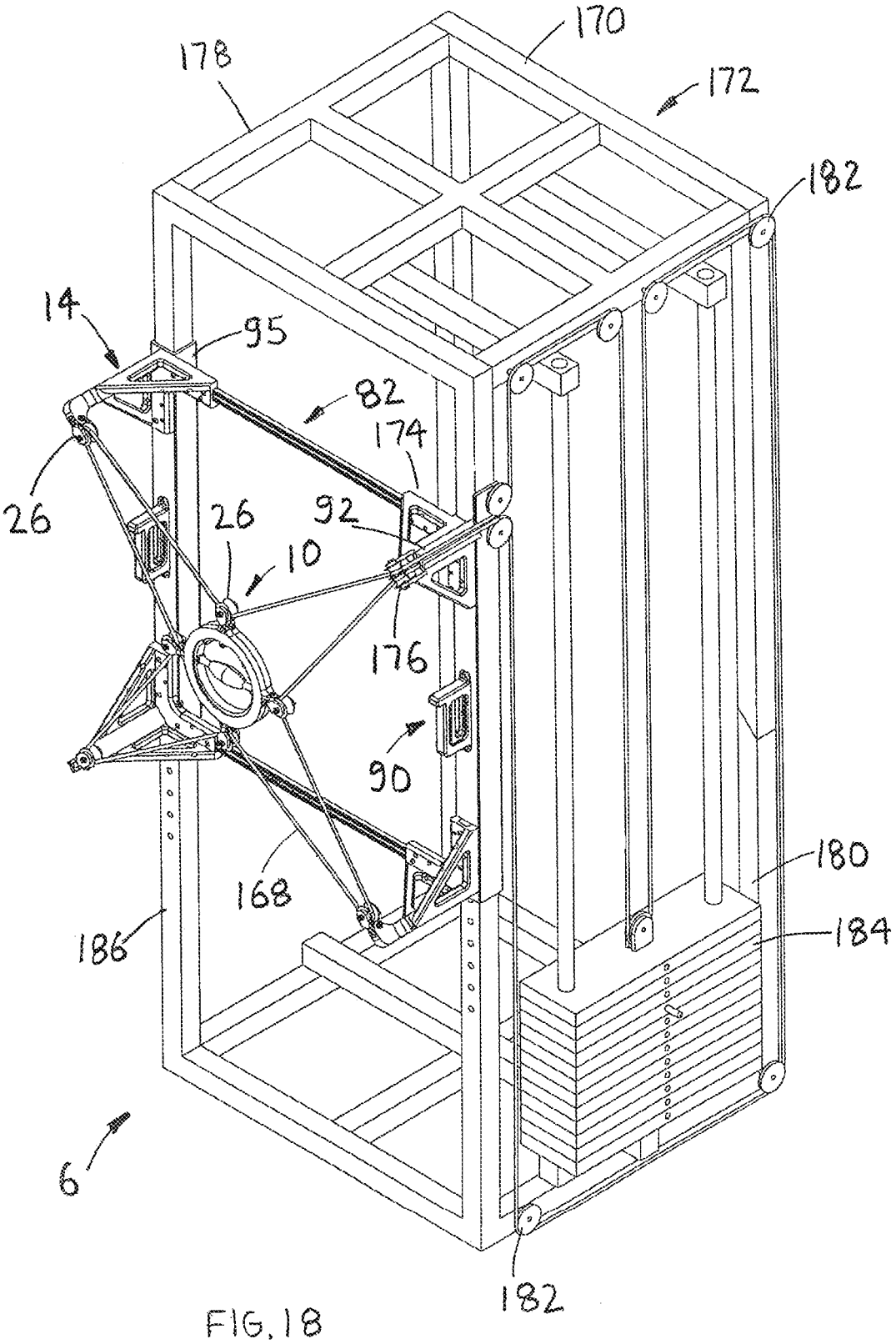
FIG. 18 is a perspective view of a shoulder exercise device having base frame with four support posts, which is slidably engaged with a weight frame, a single cable is engaged with an adjustable weight system of a shoulder exercise device in accordance with the present invention.

With reference to FIG. 18, a shoulder exercise device 6 preferably includes a single cable 168, the central handle 10, a base frame 170 and a weight device 172. The base frame 170 preferably includes four pulley support posts 14, a weight support post 174, the two horizontal frame members 86, two vertical tube members 95 and the two height adjustment handles 90. However, the shoulder exercise device 6 may be operated with only two support posts 84. The central handle 10 would be supported by the two pulley support posts 174 in opposing corners of the base frame 82. The weight support post 174 includes the vertical post 92, the first gusset 94, the second gusset 96 and dual pulleys 176. The dual pulleys 176 are disposed on a top of the vertical post 92. The single cable 168 is routed through four pulleys 26 on the central handle 10 and three pulleys 26 on the three support posts 14. The weight device 172 includes a weight frame 178, an adjustable weight lift 180 and a plurality of routing pulleys 182. Preferably, the base frame 82 is slidably mounted to a front of the weight frame 178 and the adjustable weight lift 180 is slidably retained in a side of the weight frame 178. The plurality of routing pulleys 182 are also rotatably mounted to a side of the weight frame 178. A user pulls and/or twists the central handle 10, which requires the user to overcome at least one weight 184 in adjustable weight lift 180. The two height adjustment handles 90 are attached to the two vertical tube members 95. An inner perimeter of the two vertical tube members 95 are sized to receive an outer perimeter of two weight vertical frame members 186 of the weight frame 178. Each vertical tube member 95 preferably includes a plurality of wear strips retained on an inner perimeter thereof for making contact with the outer perimeter of the two vertical weight frame members 186.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A shoulder exercise device, comprising:

a handle having an outer perimeter;

a plurality of line retainers extending from said outer perimeter of said handle;

a base frame including at least two support posts, two vertical frame members, and two height adjustment handles, said at least two support posts are respectively located in two corners of said base frame, and said two height adjustment handles are respectively located on said two vertical frame members; and a pair of slide rails slidably and respectively engaged with said two vertical frame members, respectively, wherein said pair of slide rails are configured to be attached to a vertical surface, and said two height adjustment handles adjust a height of said base frame relative to said pair of slide rails.

2. The shoulder exercise device of claim 1, wherein:

each one of said at least two support posts includes a vertical post, a first gusset, and a second gusset, and a top of said vertical post is structured to receive at least one resistance line.

3. The shoulder exercise device of claim 2, wherein:

one end of said at least one resistance line is retained by said outer perimeter, and an opposing end of said at least one resistance line is adjustably engaged with said vertical post.

4. The shoulder exercise device of claim 2, wherein:

one end of said at least one resistance line is retained by one of said at least two support posts, a middle section of said at least one resistance line is retained by said handle, and an opposing end of said at least one resistance line is adjustably engaged with a vertical post of an adjacent one of said at least two support posts.

5. The shoulder exercise device of claim 1, wherein:

each one of said two height adjustment handles includes a handle frame, a squeeze member, an indexing projection, and a biasing member, said squeeze member is biased outward from said handle frame with said biasing member, said indexing projection extends from said squeeze member, and said indexing projection is sized to be received by a plurality of holes in one of said pair of slide rails.

6. The shoulder exercise device of claim 1, further comprising:

a sliding member including a slide base and a plurality of slide pulleys, said slide base is attached to a bottom of one of said two vertical frame members, and said plurality of slide pulleys are sized to receive inward facing curved projections in one of said pair of slide rails.

7. The shoulder exercise device of claim 1, wherein:

a line hole is formed through each one of said plurality of line retainers.

8. A shoulder exercise device, comprising:

a handle having an outer perimeter and an inner rotating handle portion, which rotates relative to said outer perimeter;

a plurality of line retainers extending from said outer perimeter of said handle;

a base frame including at least two support posts, two vertical frame members, and two height adjustment handles, said at least two support posts are respectively located in two corners of said base frame, and said two height adjustment handles are respectively located on said two vertical frame members; and a pair of slide rails slidably and respectively engaged with said two vertical frame members, respectively, wherein said pair of slide rails are configured to be attached to a vertical surface, and said two height adjustment handles adjust a height of said base frame relative to said pair of slide rails.

9. The shoulder exercise device of claim 8, wherein:

each one of said at least two support posts includes a vertical post, a first gusset, and a second gusset, and a top of said vertical post is structured to receive at least one resistance line.

10. The shoulder exercise device of claim 9, wherein:

one end of said at least one resistance line is retained by said outer perimeter, and an opposing end of said at least one resistance line is adjustably engaged with said vertical post.

11. The shoulder exercise device of claim 9, wherein:

one end of said at least one resistance line is retained by one of said at least two support posts, a middle section of said at least one resistance line is retained by said handle, and an opposing end of said at least one resistance line is adjustably engaged with a vertical post of an adjacent one of said at least two support posts.

12. The shoulder exercise device of claim 8, wherein:

each one of said two height adjustment handles includes a handle frame, a squeeze member, an indexing projection, and a biasing member, said squeeze member is biased outward from said handle frame with said biasing member, said indexing projection extends from said squeeze member, and said indexing projection is sized to be received by a plurality of holes in one of said pair of slide rails.

13. The shoulder exercise device of claim 8, further comprising:

a sliding member including a slide base and a plurality of slide pulleys, said slide base is attached to a bottom of one of said two vertical frame members, and said plurality of slide pulleys are sized to receive inward facing curved projections in one of said pair of slide rails.

14. A shoulder exercise device, comprising:

a handle having an outer perimeter;

a single cable engaged with said outer perimeter;

a base frame including at least two support posts, two vertical frame members, and two height adjustment handles, said at least two support posts are respectively located in two corners of said base frame, and said two height adjustment handles are respectively located on said two vertical frame members; and a weight device including a weight frame and an adjustable weight lift, said two vertical frame members are slidably engaged with said weight frame, and said single cable is engaged with said weight lift, wherein said two height adjustment handles adjust a height of said base frame relative to said weight frame, and movement of said handle is resisted by a weight setting of said weight lift.

15. The shoulder exercise device of claim 14, wherein:

each one of said at least two support posts includes a vertical post, a first gusset, and a second gusset, and a top of said vertical post is structured to receive said single cable.

16. The shoulder exercise device of claim 15, wherein:

said single cable is retained by said outer perimeter of said handle and said at least two support posts.

17. The shoulder exercise device of claim 14, wherein:

each one of said two height adjustment handles includes a handle frame, a squeeze member, an indexing projection, and a biasing member, said squeeze member is biased outward from said handle frame with said biasing member, said indexing projection extends from said squeeze member, and said indexing projection is sized to be received by a plurality of holes in a corresponding one of two weight vertical frame members of said weight frame.

18. The shoulder exercise device of claim 14, further comprising:

each one of said two vertical frame members has a tubular cross section, an inner perimeter of said vertical frame member is sized to receive an outer perimeter of a weight vertical frame member of said weight frame.

* * * * *